United States Patent [19]

Morimoto

[11] Patent Number: 4,733,139

[45] Date of Patent: Mar. 22, 1988

[54] FLUORESCENT DISPLAY DEVICE

[75] Inventor: Kiyoshi Morimoto, Mobara, Japan

[73] Assignee: Futaba Denshi Kogyo Kabushiki Kaisha, Mobara, Japan

[21] Appl. No.: 831,508

[22] Filed: Feb. 21, 1986

[30] Foreign Application Priority Data

Feb. 28, 1985 [JP] Japan ..... 60-39880

[51] Int. Cl.[4] ..... H01J 29/70; H01J 29/72

[52] U.S. Cl. ..... 315/366; 313/422

[58] Field of Search ..... 315/366; 313/422

[56] References Cited

U.S. PATENT DOCUMENTS 3,181,027 4/1965 Geer ..... 315/14

3,531,681 9/1970 Harden, Jr. ..... 315/13.1

3,683,224 8/1972 Lea ..... 313/422

*Primary Examiner*—Theodore M. Blum

*Attorney, Agent, or Firm*—Oblon, Fisher, Spivak, McClelland & Maier

[57] ABSTRACT

A fluorescent display device is disclosed which is capable of improving visibility of luminous display of anodes. In the device, cathodes are arranged laterally out of an area opposite to the anodes so as not to hinder the observation of the luminous display. The device also includes a deflecting electrode for deflecting and diffusing electrons emitted from the cathodes so as to direct them toward the anodes.

6 Claims, 4 Drawing Figures

*(PRIOR ART)*

FLUORESCENT DISPLAY DEVICE

BACKGROUND OF THE INVENTION

1. Field of the Invention

This invention relates to a fluorescent display device which is adapted to control electrons emitted from cathodes by means of control electrodes and selectively impinge them on anodes arranged on a substrate to effect luminous display, and more particularly to a fluorescent display device of which luminous display is observed without being hindered by the cathodes.

2. Description of the Prior Art

A fluorescent display device is typically constructed in such a manner as shown in FIG. 1. More specifically, it includes a substrate 1 formed of an insulating material such as glass or the like, and a plurality of anodes 2 arranged on the substrate 1 and each comprising an anode conductor 3 and a phosphor layer 4 deposited thereon. The apparatus also includes control electrodes 5 arranged at a certain distance from the anodes 2 and filamentary cathodes 6 stretched at a distance further away from the anodes 2. Reference numeral 7 indicates a cover plate disposed opposite to the substrate 1 and 8 designates wiring conductors.

The conventional fluorescent display device constructed as described above has a disadvantage that the filamentary cathodes 6 hinders luminous display of the anodes 2 from being observed through the cover plate 7 to deteriorate the visibility of the device, because the cathodes are interposed between the anodes 2 and the cover plate 7 opposite thereto.

This disadvantage is encountered with not only a fluorescent display device of the front emission type that the cover plate 7 is formed of a light-permeable material to cause luminous display of the anodes 2 to be observed through the cover plate 7 or from the lower side in FIG. 1, but a fluorescent display device of the type that luminous display is observed through the substrate 1 or the upper side in FIG. 1, because the red-hot filamentary cathodes 6 are intermittently observed through interstices each formed between each adjacent two anodes 2.

A fluorescent display device has been extensively used for various applications, for example, for a variety of display apparatus mounted on vehicles such as a car and the like. A fluorescent display device used for vehicles generally undergoes a specific restriction that only a single power source (a battery of 12 V or 24 V) is used for its power source. In general, in a fluorescent display device, it is required to keep potential of cathodes substantially lower than that of a power source in order to utilize potential between anodes and the cathodes. For this purpose, it is necessary to cause voltage drop across the power source to be generated by a suitable means such as a resistive divider to maintain the cathodes at suitable potential. However, the single power source has a serious problem of causing much power loss when the voltage drop occurs, because a large amount of current must be flowed through the filamentary cathodes to heat them.

In view of the foregoing, an indirectly heated cathode structure has been proposed which comprises electron emitting cathodes and heaters for heating the cathodes arranged in a manner to be electrically separate from each other and is adapted to keep them at different potentials. In the indirectly heated cathode structure, voltage applied to the heaters for heating the cathodes is not substantially limited. Accordingly, the direct connection of the heaters to a power supply may be permitted. This avoids dropping voltage across the power source by means of a resistive divider or the like to obtain lower voltage, resulting in the heaters effectively utilizing electric power. Further, the indirectly heated cathode structure has another advantage that the cathodes are merely required to be earthed, thereby power consumption for ensuring cathode potential required may be eliminated.

However, the indirectly heated cathode structure is obliged to have an highly increased diameter, because it is so constructed that an electrically conductive core is coated with an insulating layer, on the outer surface of which cathodes are then provided. Accordingly, the application of the indirectly heated cathode structure to a fluorescent display device used for a vehicle further promotes the above-described deterioration of visibility of the fluorescent display device.

Furthermore, the use of sulfide phosphor such as ZnS:Cu, (Zn,Cd)S:Ag or the like as often observed in a multi-color fluorescent display device leads to the generation of S gas and/or sulfide gas such as $SO_2$ and the like from the phosphor due to the impingement of electrons thereon, which substantially deteriorate an electron emitting material, such as, for example, (Ba,Sr,Ca)O contained in the cathodes to significantly decrease the electron emitting capability of the cathodes, resulting in the lifetime of the fluorescent display device being highly reduced.

SUMMARY OF THE INVENTION

The present invention has been made in view of the foregoing disadvantage of the prior art.

Accordingly, it is an object of the present invention to provide a fluorescent display device which is capable of eliminating the above-described disadvantage of the prior art such as the deterioration of visibility of luminous display therefrom and the like due to the structural restriction.

It is another object of the present invention to provide a fluorescent display device which is capable of exhibiting satisfied visibility of luminous display by arranging cathodes at an area out of that opposite to anodes.

Briefly, in accordance with the present invention, a fluorescent display device is provided which is adapted to control electrons emitted from cathodes by means of control electrodes and impinge the electrons on anodes to excite the anodes, to thereby effect luminous display. The cathodes are arranged laterally out of an area opposite to the anodes. The fluorescent display device includes a cover plate arranged opposite to the anodes, which has a deflecting electrode deposited thereon. The deflecting electrode is kept at potential intermediate between the potential of the cathodes and that of the anodes to deflect the electrons emitted from the cathodes while diffusing them to direct the electrons toward the anodes, resulting in the provision of any cathode in a manner to be opposite to the anodes being eliminated.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference numerals designate like or corresponding parts throughout, wherein.

DETAILED DESCRIPTION OF THE PREFERRED EMBODIMENTS

Now, a fluorescent display device according to the present invention will be described hereinafter with reference to FIGS. 2 to 4.

Figure 1:
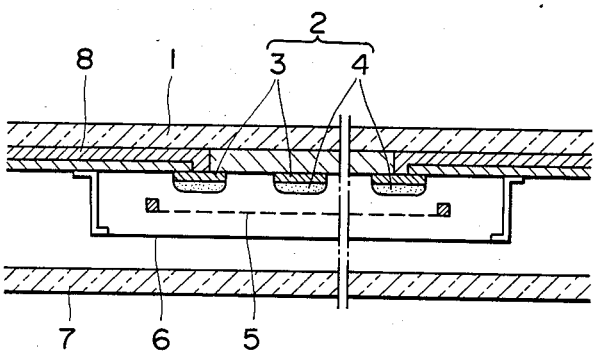
FIG. 1 (PRIOR ART)
FIG. 1 is a vertical sectional view showing the essential part of a conventional fluorescent display device.
Figure 2:
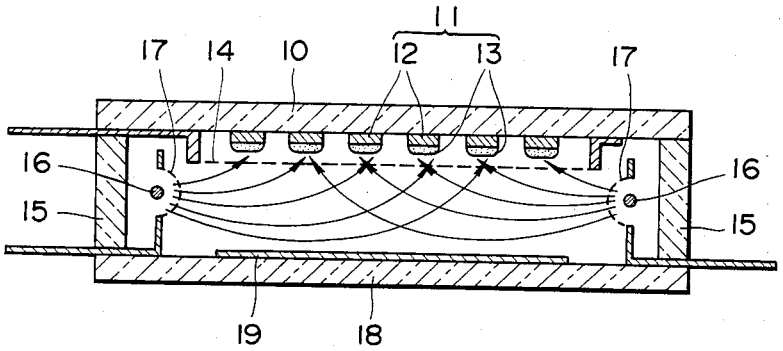
FIG. 2 is a vertical sectional side view showing an embodiment of a fluorescent display device according to the present invention.

FIG. 2 shows an embodiment of a fluorescent display device according to the present invention. A fluorescent display device of the illustrated embodiment comprises an evacuated casing which includes a substrate 10 having a plurality of anodes 11 arranged thereon. The anodes 11 each comprise an anode conductor 12 and a phosphor layer 13 deposited thereon. The apparatus also includes control electrodes 14 in a manner to be spaced from the anodes 11 and cover all the anodes.

The illustrated embodiment also includes cathodes 16 arranged in lateral areas out of that opposite to the anodes 11 or in the vicinity of side walls 15 of a casing and an electron extraction electrode 17 arranged in front of each of the cathodes 16 to accelerate electrons emitted from the cathodes 16. The casing also has a cover plate 18 disposed opposite to the substrate 10. On a rear surface portion of the cover plate 18 opposite to the anodes 11 is deposited a diffusion electrode 19, which is formed of an electrically conductive film.

Figure 3:
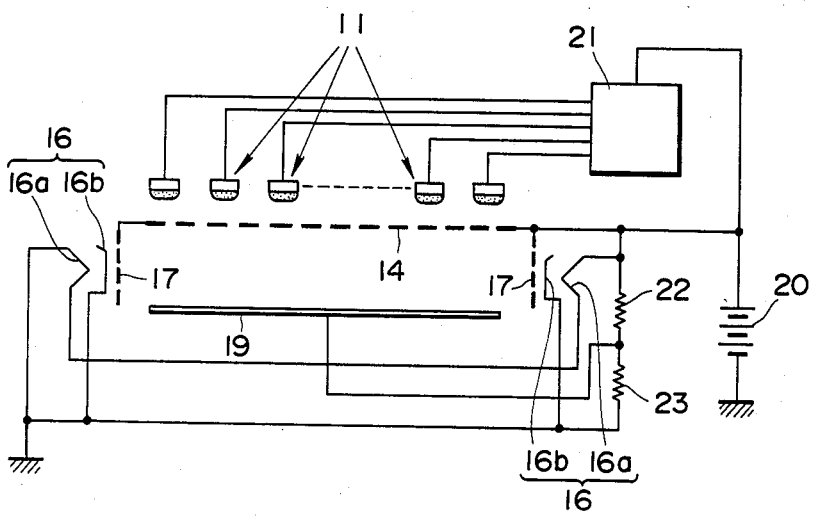
FIG. 3 is a circuit diagram of the fluorescent display device shown in FIG. 2.

FIG. 3 is a circuit diagram showing the fluorescent display device of the illustrated embodiment equipped in a vehicle, wherein the cathodes 16 each are constructed in the form of an indirectly heated cathode. In FIG. 3, reference numeral 20 designates a power source connected to the anodes 11 through a control circuit 21 which is adapted to selectively control the anodes 11 depending upon an image to be displayed, to thereby apply anode voltage across the anodes 11. Also, the power source 20 is connected to the control electrodes 14, electron extraction electrodes 17 and a heater **16*a* of each of the indirectly heated cathodes 16 to apply source voltage (12 V or 24 V) across each of the elements. The source voltage is subjected to voltage drop by bleeder resistances 22 and 23 and then led to the deflection. A cathode layer 16*b* of each of the indirectly heated cathodes 16 is kept at earth potential. Thus, it will be noted that the deflecting electrode 19** is applied thereto intermediate potential between cathode potential (earth potential) and anode potential.

Now, the manner of operation of the fluorescent display device of the illustrated embodiment will be described hereinafter.

Electrons emitted from cathode layers **16*b* heated by the heaters 16*a* are accelerated by the electron extraction electrodes 17 and then exposed to electric field formed by the deflecting electrode 19 and the control electrodes 14 as shown in FIG. 2 to be deflected while being substantially diffused. Thus, the electrons are directed toward the anodes 11** and then impinged thereon to effect luminous display.

The fluorescent display device of the illustrated embodiment may be of the type that luminous display is observed through the substrate 10 or the type that it is observed through the cover plate 18. In the former type, it is required that the substrate 10 and anodes 11 are formed of a light-permeable material. In the latter type, the cover plate 18 and diffusion electrode 19 are formed of a light-permeable material.

Figure 4:
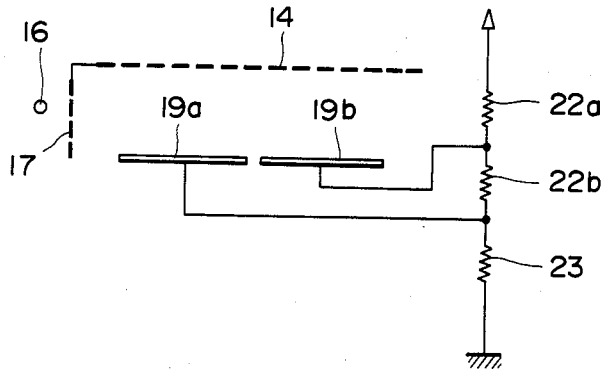
FIG. 4 is a circuit diagram showing another embodiment of a fluorescent display device according to the present invention.

FIG. 4 shows another embodiment of a fluorescent display device according to the present invention. In the embodiment shown in FIG. 4, a deflecting electrode 19 is divided into a plurality of electrode sections **19*a* and 19*b* so as to cover the anodes divided into a plurality of groups, respectively. The electrode sections 19*a* and 19*b* are exposed to multi-stage voltage drop by bleeder resistances 22*a* and 22*b*** to be kept at different potentials. Such construction permits luminance of the anodes to be adjusted every anode group covered by the corresponding deflecting electrode section.

The remaining part of the embodiment shown in FIG. 4 is constructed in substantially the same manner as that shown in FIG. 2.

As can be seen from the foregoing, the fluorescent display device of the present invention is so constructed that the cathodes which emit electrons toward the anodes are arranged laterally out of an area opposite to the anodes. Such construction permits the fluorescent display device to exhibit excellent visibility because there is no obstacle hindering the observation of luminous display of the anodes in the field of view.

Such an improvement in visibility is accomplished in both a fluorescent display device of the type that luminous display is observed through a substrate and that of the type of observing it through a cover plate.

Also, such advantages of the present invention are effectively attained in a fluorescent display device for a vehicle which employs an indirectly heated cathode structure of a much larger diameter as well, because even the structure is out of the field of view. Accordingly, it will be noted that the present invention is of practical use. More particularly, an indirectly heated cathode structure has been very difficult to employ in a conventional fluorescent display device because of its large diameter sufficient to hinder the observation of luminous display, however, the present invention allows such a cathode structure to now be applied to a fluorescent display device. This also exhibits another advantage of solving a problem due to the operation by a power source.

Furthermore, the construction that the cathodes are arranged out of an area opposite to the anodes effectively eliminates a disadvantage as encountered with a color fluorescent display device using sulfide phosphor that cathodes are deteriorated by S gas and/or S containing gas such as $SO_2$ and the like which are produced from phosphor layers of anodes due to the impingement of electrons thereon. This prevents the electron emitting capability of the cathodes from being deteriorated and highly increases the lifetime of a fluorescent display device.

While preferred embodiments of the invention have been described with a certain degree of particularity with reference to the drawings, obvious modifications and variations are possible in the light of the above teachings. It is therefore to be understood that within the scope of the appended claims, the invention may be practiced otherwise than as specifically described.

What is claimed as new and desired to be secured by Letters Patent of the United States is:

1. A fluorescent display device comprising:

an evacuated casing having a substrate, side walls and a cover plate;

at least one display section formed on said substrate, said display section having a plurality of anodes each comprising anode conductors having a phosphor layer deposited on the surface thereof so as to effect luminous display by selectively applying display signals to said anodes depending upon an image to be displayed;

cathodes for emitting a shower of unfocused electrons to be impinged upon said anodes, said cathodes being arranged laterally out of an area opposite to said anodes;

control electrodes for controlling electrons emitted from said cathodes, said control electrodes comprising, first control electrodes arranged in front of each of said cathodes for extracting the shower of unfocused electrons emitted from said cathodes and for accelerating the shower of unfocused electrons into an evacuated space in said casing, and second control electrodes arranged in a manner to be spaced from and opposite to said anodes for accelerating and controlling the shower of unfocused electrons extracted into said evacuated space in said casing so as to impinge electrons upon said anodes; and a deflecting electrode having a constant voltage applied thereto formed on said cover plate for deflecting and diffusing the shower of unfocused electrons within said evacuated space in said casing;

wherein said deflecting electrode is kept at a different potential intermediate between the cathode potential and the anode potential during the operation of said fluorescent display device.

2. The fluorescent display device as defined in claim 1, wherein said cover plate and deflecting electrode each are formed of a light-permeable material to permit luminous display to be observed through said cover plate.

3. The fluorescent display device as defined in claim 1, wherein said substrate is formed of a light-permeable material to permit luminous display to be observed through said substrate.

4. The fluorescent display device as defined in claim 1, wherein said cathodes each are constructed in the form of an indirectly heated cathode.

5. The fluorescent display device as defined in claim 1, wherein said cathodes each are constructed in the form of a directly heated cathode.

6. The fluorescent display device as defined in claim 1, wherein said deflecting electrode is divided into a plurality of electrode sections, and each of said electrode sections is kept at a different constant potential intermediate between the cathode potential and the anode potential through connection to bleeder resistance during the operation of said fluorescent display device.

* * * * *